United States Patent [19]

Lutjens et al.

[11] Patent Number: 4,487,256

[45] Date of Patent: Dec. 11, 1984

[54] CRYOGENIC HEAT EXCHANGER

[75] Inventors: Robert D. Lutjens, Hacienda Heights; Paul P. Duron, Corona Del Mar, both of Calif.

[73] Assignee: Cryomec, Inc., Anaheim, Calif.

[21] Appl. No.: 282,259

[22] Filed: Jul. 10, 1981

[30] Foreign Application Priority Data

Jul. 10, 1980 [CH] Switzerland ..... 5295/80

[51] Int. Cl.[3] ..... F28F 1/20

[52] U.S. Cl. ..... 165/76; 62/52; 165/183

[58] Field of Search ..... 62/52; 165/183, 76, 165/82

[56] References Cited

U.S. PATENT DOCUMENTS

| | | | |
|---|---|---|---|
| 1,841,380 | 1/1932 | Phelps et al. | 165/183 |
| 2,405,722 | 8/1946 | Villier . | |
| 3,280,907 | 10/1966 | Hoffman | 165/185 |
| 3,672,446 | 6/1972 | Tibbetts et al. | 165/183 |
| 4,158,908 | 6/1979 | Block et al. | 165/171 X |
| 4,367,791 | 1/1983 | Asami | 62/52 X |

FOREIGN PATENT DOCUMENTS

| | | | |
|---|---|---|---|
| 391665 | 9/1921 | Fed. Rep. of Germany | 165/183 |
| 405733 | 9/1921 | Fed. Rep. of Germany | 165/183 |
| 693868 | 6/1940 | Fed. Rep. of Germany | 165/183 |
| 38249 | 4/1931 | France | 165/183 |
| 56-44591 | 4/1981 | Japan | 165/183 |
| 361902 | 6/1962 | Switzerland | 165/183 |
| 319683 | 6/1930 | United Kingdom | 165/183 |
| 2079923 | 1/1982 | United Kingdom | 62/52 |
| 2082310 | 3/1982 | United Kingdom | 165/183 |

OTHER PUBLICATIONS

Hex Industries, Inc., "Installation and Operation Instructions, VAN-804 Vaporizer Modules", 3/26/76.

Cryo-Chem, Inc. Air Vaporizers, 9/79.

*Primary Examiner*—Sheldon J. Richter

*Attorney, Agent, or Firm*—Knobbe, Martens, Olson & Bear

[57] ABSTRACT

A heat exchanger for vaporizing a cryogenic fluid comprises a conduit through which the fluid is passed and a heat transfer sleeve surrounding the conduit. The sleeve is comprised of two heat transfer sections, each having a central arcuate portion in close partial circumferential contact with the conduit, a plurality of radially extending heat transfer fins, and a pair of interlocking members located on the fins at a predetermined distance from the central portion for assembling the two sections together around the conduit. In the assembled state, the resiliency of the fins on which the interlocking members are located provides a continuous clamping for which permits the two central portions to maintain intimate contact with the conduit as it undergoes thermal contraction, while also facilitating assembly and disassembly of the two sections. Each heat transfer fins is also provided with a corrugated or rippled surface near its tip to increase its surface area and the rate of heat transfer and vaporization.

15 Claims, 6 Drawing Figures

Fig. 1
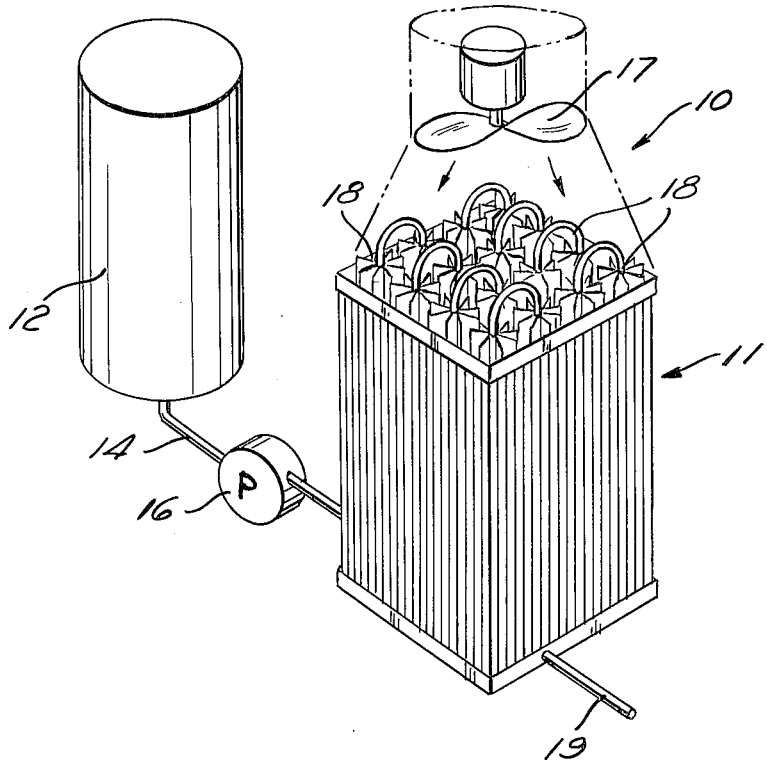
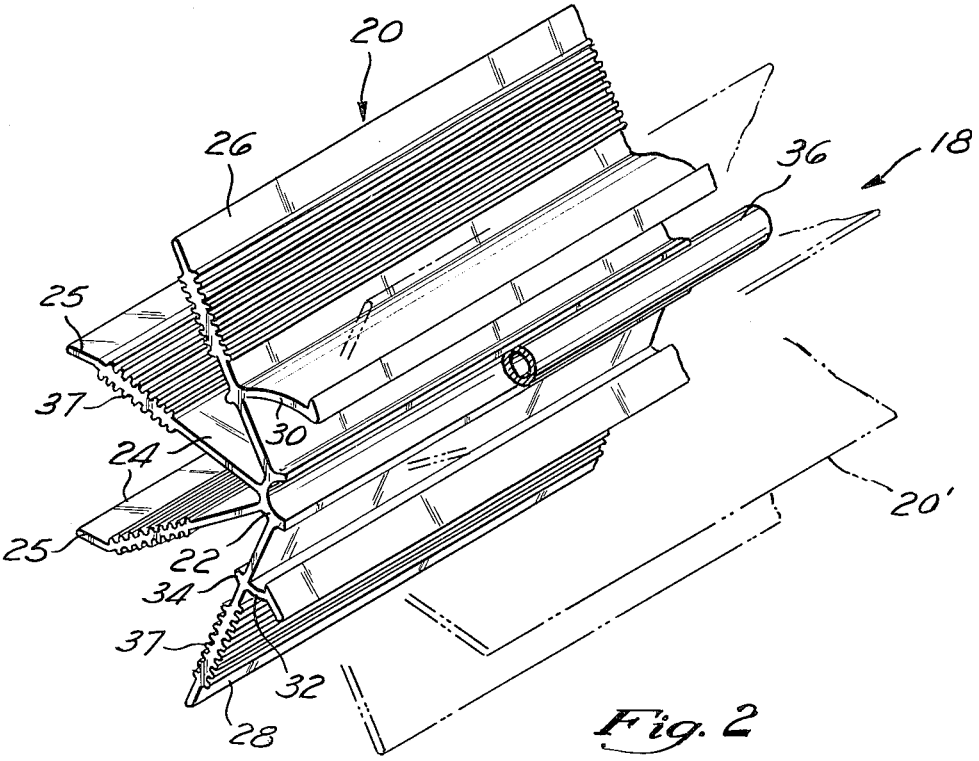
Fig. 2

Fig. 3
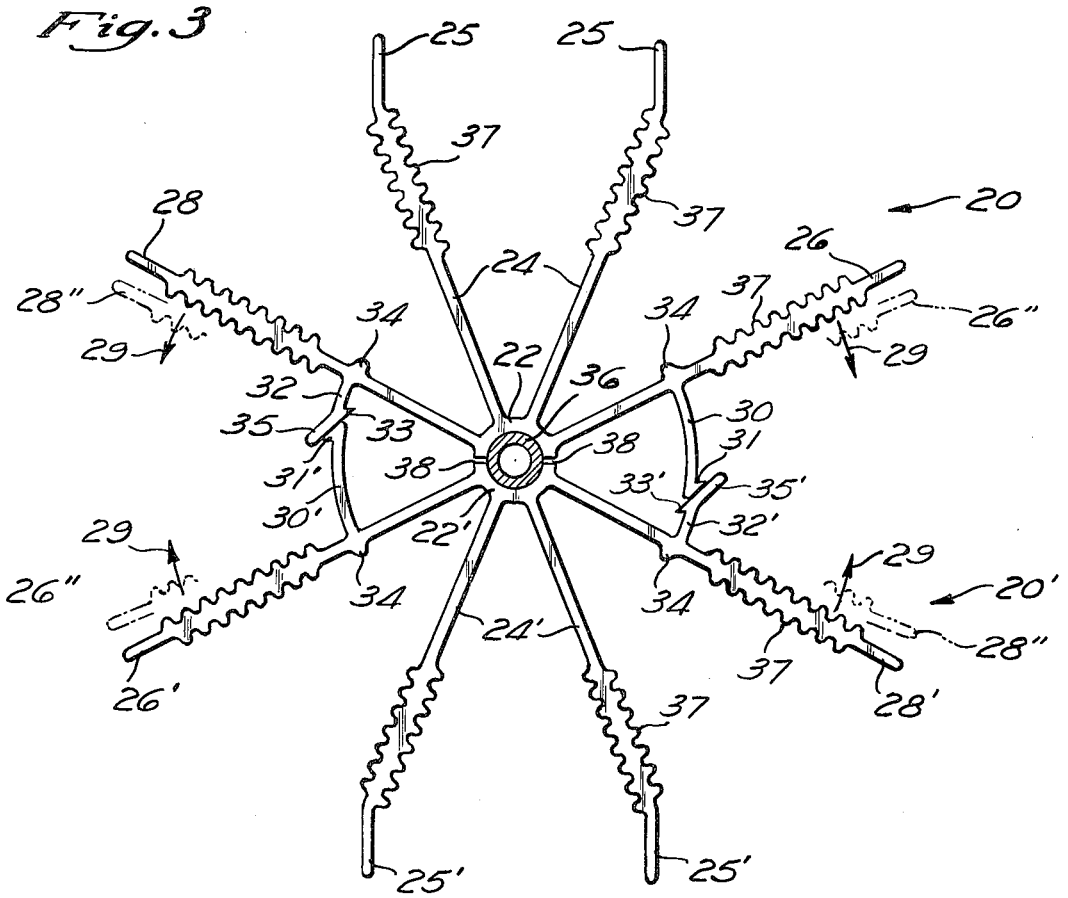
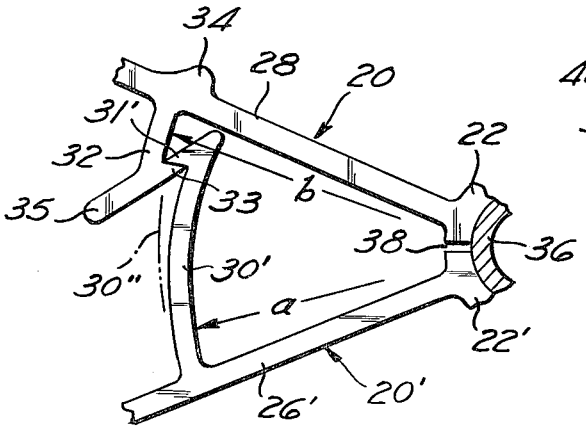
Fig. 4
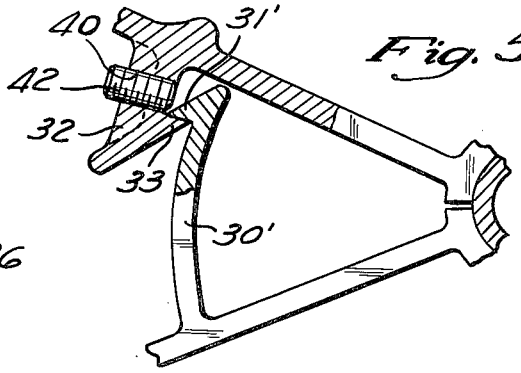
Fig. 5
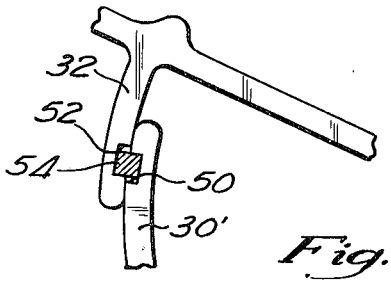
Fig. 6

CRYOGENIC HEAT EXCHANGER

BACKGROUND

This invention related to an improved form of heat exchanger for cryogenic fluids. The use of a heat exchanger results in the relatively rapid warming and vaporization of cryogenic fluids, e.g. liquid nitrogen, liquid oxygen, etc. In practice, the cryogenic fluid is removed from a storage tank and passed via a conduit to the user. While in transit, heat from the ambient air warms the conduit and vaporizes the cryogenic fluid. The resulting vapors are used in a wide variety of industrial applications, including welding, missle fuel tank filling, and the like.

Generally, the heat exchanger takes the form of heat transfer elements or sleeves which surround and closely contact the conduit through which the cryogenic fluid is passing. These sleeves are made from a material having a relatively high thermal conductivity and typically are provided with fins or other extended surfaces in order to increase their surface area, thereby resulting in more rapid vaporization. Most heat exchanger units consist of approximately a dozen or more separate sleeve sections which are arranged in a vertical parallel fashion and which are interconnected by a manifold system so that the cryogenic fluid passes through them in serpentine fashion.

Early heat transfer sections consisted of long, multifined extruded aluminum sections with a hole centrally located and running the length of the section. As the cryogenic fluid passed through the axially extending hole, heat was transferred from the air to the fluid, warming and vaporizing the fluid. A vaporizer unit consisted of a plurality of such heat transfer sections disposed vertically and arranged in a bank. The sections were connected in series, with the conduit welded to the output opening of one section being welded to the input opening of the next section. However, the large number of welds required proved to be a substantial defect of this method since the welds often failed due to the extreme pressure from the cryogenic fluid, the thermal cycling of the vaporizer, and the differential rate of contraction of dissimilar metals. The failure of these welds lead to leakage, loss of pressure and other related problems.

Later vaporizing systems contained the cryogenic fluid in a continuous conduit and surrounded the conduit with heat transfer sections. These methods eliminated the welding proglems of earlier vaporizers but created the new problem of locking the heat transfer sections to the conduit so as to provide effective thermal contact between them. One method used a conduit extending through an axially extending hole in the heat transfer section. The conduit was slightly undersized for the hole, effective thermal contact being effected by expanding the conduit under the large pressure exerted by the cryogenic fluid. This method suffered from leakage problems, lack of good thermal contact and economic unfeasibility.

An alternative system for providing effective thermal contact between the conduit and the heat transfer section uses two identical heat transfer sections which are joined longitudinally around the conduit. Each section has a central cylindrical hub portion for engaging the conduit, a plurality of fins extending radially from the central hub for collecting the heat, and two short locking members disposed on the hub for locking the two heat transfer sections together around the conduit. When the two sections are placed around the conduit, the pair of hub portions join circumferentially around the conduit and the two locking members are in close physical proximity, one pair on each side of the conduit. With the aid of a specially designed machine the longer, deformable locking member is folded over the shorter, adjacent fixed locking member. The longer member extends around the shorter member, thereby holding the two heat transfer sections together around the conduit.

This method suffers from some substantial defects. First, this method does not always provide good thermal contact between the heat transfer sections and the conduit, since the very low temperatures of cryogenic liquids cause the conduit to contract away from the hub portions. As a result, an air or ice gap forms between the conduit and the heat transfer sections, thereby substantially reducing the efficiency of the heat exchanger. Secondly, the heat transfer sections must be assembled by means of a highly particularized, bulky, and expensive machine which sometimes even deforms the heat transfer sections or the conduit. Thus, the conduit must be fitted with the heat transfer sections prior to assembly of the conduit structure. Also, assembly is impossible in the field, and disassembly and reuse of the heat transfer sections is virtually impossible.

In addition, a substantial amount of ice builds up on the heat transfer sections immediately surrounding the central hub portions, thereby preventing the efficient flow of heat from the air to the conduit. This icy build-up is substantially accelerated by the location of the locking members on the hub portions, since these locking members increase the heat transfer surface area in the vicinity of the hubs. As a result, the heat exchanger must be shut down and the fins and hub portions deiced, resulting in a severe loss of time and increased expense. Another disadvantage resulting from the location of the locking members on the central hubs is that all of the fins cannot extend directly from the center section, thereby increasing the path length which the heat must be conducted in order to reach the conduit.

SUMMARY OF INVENTION

The heat exchanger of the present invention remedies the above describe defects of the prior art by providing interconnecting locking means which are located on the radially extending fins a predetermined distance from the center section. Thus, the resiliency of the fins provides a clamping or engaging force which maintains intimate contact between the center section of the heat transfer sections and the conduit through which the cryogenic fluid flows, even though the conduit may contract due to the extremely cold temperatures of the fluid.

By means of this interlocking system, the heat transfer sections can be easily assembled to or disassembled from the conduit in the field. In addition, the fins are provided with a corrugated or rippled structure near their tips in order to increase their surface area and maximize the efficiency of the heat exchanger. Also, the location of the interlocking members a certain distance away from the center section permits the free flow of warm ambient air around the center section, thereby reducing the amount of icy build-up on that section.

In the present heat exchanger, two identical heat transfer sections are jacketed about the conduit through which the cryogenic fluid is passed. Each heat transfer section is comprised of a central arcuate section which intimately contacts the conduit in both circumferential and longitudinal directions. A plurality of heat transfer fins extends substantially radially from the central section, each fin having a rippled or corrugated surface on their tips. A pair of interlocking members are located on the fins closest the other heat transfer section at a predetermined distance from the center section for locking the two sections together and for maintaining close contact between the conduit and the central sections. To acommodate thermal contraction due to the extreme cold of the cryogenic fluid, the two central sections are each less than 180° to provide small gaps which permit the central sections to contract with the conduit in response to the clamping force generated by the resilient fins on which the interlocking members are located.

The present heat exchanger provides excellent thermal contact between the heat transfering sections and the conduit over its complete temperature range of operation. Efficient heat transfer to the fluid is assured because no air or ice gaps can form between the central sections and the conduit. This clamping method takes advantage of the natural resiliency of the fin material by elastically deforming the fins to provide a clamping force during assembly, and providing interconnecting tabs to hold the fins in a stressed state. By disposing the connecting tabs away from the center section, only a small amount of deformation is needed to provide a sufficiently strong clamping force. The amount of clamping force can be increased by increasing the deformation of the fins, although the amount of deformation is less than that required for plastic deformation.

The present method of interconnecting the heat transfer section allows for their quick assembly without the use of a machine, so that assembly can be easily accomplished in the field. The heat transfer sections need only be placed around the conduit and pressed together, either manually or by the use of simple hand tools. The interlocking members have tabs which will catch and hold the fins in the deformed position. The sections can even be attached to an existing conduit structure. For reuse of the heat transfer sections is accomplished by disconnecting the interlocking tabs, which themselves are resilient to aid in the assembly or disassembly process.

By placing the locking tabs on the fins and away from the center section, the ice build-up problem is substantially reduced. That is, the area near the center section is open and unobstructive to the circulation of ambient air which reduces the amount of ice accumulating on the central sections. In addition, the amount of surface area on which the ice can form is reduced. Furthermore, since the locking members are located on the fins, all of the fins may extend directly from the central arcuate section.

BRIEF DESCRIPTION OF THE DRAWINGS

FIG. 1 is a perspective view of a typical ambient air heat exchange illustrating the upright heat transfer sleeves surrounding several conduits which are manifolded together;

FIG. 2 is a partial perspective view of a length of a heat transfer section, with the position of the complementary heat transfer section being shown in phantom or dot-dash lines;

FIG. 3 is an end view showing two heat transfer sections disposed about a conduit in a partially assembled state, the dotted lines showing the position in the assembled state of the outer fins on which the interlocking members are located;

FIG. 4 is a partial end view of the hook like interlocking tabs on the locking members, the dotted line showing the position of the outwardly facing tab in the unassembled state;

FIG. 5 is a partial end view of the interlocking tabs showing one method for disassembly of the two heat transfer sections; and FIG. 6 is a partial end view of an alternative interconnecting system.

DETAILED DESCRIPTION OF THE PREFERRED EMBODIMENT

FIG. 1 shows the heat exchanger 10 in an environmental view in an ambient air vaporizer bank 11. Although the heat exchanger 10 is shown in an ambient or open system, the principles of the present invention apply equally to a closed system with a heat source other than ambient air. The cryogenic liquid is stored in a tank 12 and is forced by a pump 16 via an inlet conduit 14 into the ambient air vaporizer bank 11. If the cryogenic liquid is nitrogen, the temperature of the liquid in the tank 12 is approximately 77 K (−320° F.). The cryogenic fluid passes serially through the separate heat transfer elements or sleeves 18 of the bank 10. The conduits 36 (shown in FIG. 2) through which the cryogenic liquid is pumped extend continuously in a serpentine fashion through the bank 10 being interconnected by manifold pipes 15 and eventually leading to the outlet conduit 19. Heat is transferred from the ambient air bathing the conduit sleeves 18 to the conduits 36. As the cryogenic liquid passes through these conduits, it is warmed and vaporized. The now vaporized fluid exits the vaporizer bank 11 via the outlet conduit 19. The ultimate user of the vaporizer is located downstream of the conduit 19.

The rate of vaporization will depend on a variety of factors including the ambient air temperature and the rate of air flow through the bank 11. The latter can be increased by adding a fan 17 above the bank 11, although natural air convention is also an acceptable mode of operation. Alternatively, the sections may be placed in a closed system having a liquid or gas bath at any desired temperature.

FIG. 2 is a perspective view of a sleeve 18 which is comprised of two identical heat transfer sections 20 and 20', the latter of which is shown in dot-dash lines, the sections 20 and 20' are assembled around the conduit 36. Each heat transfer section 20 is comprised of a center section 22, inner fins 24, outer fins 26 and 28, and resilient locking members 30 and 32. In the preferred embodiment, the heat transfer section 20 is uniform along its longitudinal dimension, making extrusion the preferred method of manufacture. The extruded heat transfer sections are typically cut in 6' to 10' sections, with the fins being 4" to 5" in length.

The conduit 36 runs the entire length of the heat transfer section 20 extending beyond both ends a distance sufficient to provide suitable coupling to the manifold pipes 15. The conduit 36 will intimately contact the inner arcuate portion of the center section 22 both circmferentially and longitudinally, the outer diameter of the former conforming to the inner diameter of the latter. Integral to an extending substantially radially from the center section 22 are inner fins 24 and outer fins 26 and 28, the latter being closest to or adjacent the complementary heat transfer section 20. All of the fins 24, 26 and 28 and the center section 22 function to transfer heat from the ambient air, through the fins and the center section to the conduit 36 and the contained fluid. It will be appreciated that the rate of heat transfer to the cryogenic fluid may be increased by increasing the surface area of the fins and by constructing the heat transfering sections 20 out of a material of relatively high thermal conductivity. FIG. 2 also shows a corrugated surface or ripples 31 near the top of the fins as one means of increasing their surface area. Advantageously, these ripples 31 are located away from the center section 22 in order to provide for increased circulation of ambient air in that vicinity, resulting in turn in less ice build-up and more efficient heat transfer.

FIG. 3 shows two heat transfer sections 20 and 20' surrounding the conduit 36 in their respective positions immediately prior to assembly. These sections 20 and 20' are identical, one being rotated with respect to the other by a 180° rotation around the center section 22. As a result of this identity, only a single extrusion is needed to make both heat transfer sections 20 and 20'. The outer fins 26 and 28 have resilient locking members 30 and 32 extending circumferentially from them. The two center sections 22 and 22' do not quite meet, leaving gaps 38 between them.

Although the fins 24, 26, and 28 are similar in function, they differ slightly in structure. The two inner fins 24 angle slightly at their tips 25, becoming essentially parallel, in order to facilitate assembly. This angling of the tips 25 provides for the use of a bar or other hand tool to be placed on ridges 34 located on the outer fins 26 and 28 in the assembly process, as will be explained in more detail below. These ridges 34 are positioned on the sides of fins 26 and 28 opposite the sides bearing the locking members 30 and 32 and extend longitudinally along the length of the heat transfer section 20. More than two inner fins 24 may be used if desired. The outer fins 26 and 28 are basically similar to the inner fins 24 but have locking members 30 and 32 integral to and extending essentially locally perpendicularly from the underside. Each of the resilient locking members 30 and 32 is provided with a interlocking tab 31 and 33 which holds the heat transfer sections 20 and 25 tightly around the conduit 36. The locking members 30 and 30' have outwardly facing tabs 31 and 31', respectively, while the locking members 32 and 32' have inwardly facing tabs 33 and 33'. As shown in FIG. 3, the locking members 32 and 32' are provided with extended angled sections 35 and 35'. Just prior to assembly, the outer edges of the interlocking tabs 31 and 31' rest against the inner-surfaces of these angled sections 35 and 35', respectively, which serve to facilitate assembly, as described in more detail below.

Assembly of the two heat transfer sections 20 and 20' is initiated from the positions shown in FIG. 3. The outer fins 26 and 28 and the complementary outer fins 26' and 28' are drawn towards each other, as shown by the arrows 29. As these fins are drawn towards their respective counterparts, the resilient locking members 30, 30', 32 and 32' may flex inwardly slightly in a radial direction, as shown by the arrows 29', thereby facilitating assembly. Eventually, the outwardly facing interlocking tabs 31 and 31' engage the inwardly facing interlocking tabs 33 and 33'. The heat transfer sections 20 and 20' are then locked onto the conduit 36 until such time as they are removed. Once in the assembled position, the outer fins 26, 26', 28 and 28' will be in the position shown by the dot dash lines 26'' and 28''.

The resilient locking members 30 and 32 are drawn toward one another by use of a compressive force applied to the heat transfer sections 20 and 20'. This compressive force may be a manual force applied to the outer fins 26 and 28, in which the complementary pairs of fins 26 and 28 are simply compressed toward one another. The same effect could be accomplished by placing a compression spring between the fins 26 and 28 thereby spring loading them to generate the clamping force. Alternatively, a bar or other hand tool may be applied to the ridges 34 which are located on the fins 26 and 28 and a compressive force applied thereto, in order to engage the interlocking tabs 31 and 33. It will be recognized that the angle sections 35 provide guidance and stability to the interlocking tabs 31 in order to accomplish a secure interconnection between the heat transfer sections 20 and 20'. An alternate method of assembly involves achieving the interconnection between one pair of interlocking tabs on one side of the conduit 36 and then subsequently interlocking the taps on the opposite side of the conduit, rather than achieving this interlocking simulaneously. Thus, for example, tabs 31 and 33' might be interlocked first, followed by compression of the fins 26' and 28 until the interlocking tabs 31' and 33 are interlocked. In this instance, the conduit 36 acts as a type of fulcrum while the heat transfer sections 20 and 20' serve as levers which are flexed over the conduit 36 until the interlocking 31' and 33 are securely engaged.

The outwardly facing locking member 30 can be, but need not be, made somewhat longer than the inwardly facing locking member 32 so as to facilitate assembly. The locking member 30 will exhibit more flexibility in a radial direction away from the center 22 than will the shorter, inwardly facing locking member 32. As a result, less compression force will be needed in assembly.

FIG. 4 shows the locking members 32 and 30' in their assembled relation. The dot dash line 30'' shows the unassembled, unstressed position of the longer, outwardly forcing locking member 30''. This invention will function equally well if the outwardly facing locking member 30' faced inwardly and the inwardly facing locking member 32 faced outwardly.

By reference to FIG. 3 it will be appreciated that the clamping force on the conduit 36 exists because the outer fins 26 and 28 have been flexed or deformed and then locked in that position. The natural resiliency of the fin material provides a clamping force arond the conduit 36 tending to close the gap 38. Furthermore, the flexible locking members 30 and 32 may deform slightly during the assembly process, or even remain slightly deformed after assembly. The resultant amount of clamping force acting on the conduit 36 will depend on the material used and the extent to which the outer fins 26 and 28 are deformed from their non-assembled, non-stressed position, the latter being in turn a function of the lengths of the locking members 30 and 32 and the distances at which the locking members are placed on the fins 26 and 28 from the center section 22. These lengths should be chosen such that the clamping force will be sufficient to maintain good heat transfer contact between the conduit 36 and the center sections 22 and 22' when the conduit 36 thermally contrasts due to the extremely cold temperatures of the cryogenic liquid passing through it.

Thus, as the conduit 36 contracts, the clamping force generated by the resiliency of the fins 26 and 28 draws the two heat transfer sections 20 and 20' together, thereby reducing the gaps 38. As a result, the outer fins 26 and 28 are relaxed slightly and the clamping force is reduced. However, intimate contact is maintained between the center arcuate sections 22 and 22' and the conduit 36 in order to provide efficient heat transfer to the conduit and the cryogenic liquid within. In addition, the center sections 22 are dimensioned and sufficient clamping force is provided so that even with maximum contraction of the conduit 36, close thermal contact will be maintained between the heat transfer sections and the conduit.

The amount of deformation should not be so great that plastic deformation of the fins 26 and 28 occurs. Also, the clamping force should not be so great that it will cause the cold, brittle conduit 36 to collapse. The latter problem can be solved by selecting a conduit 36 made out of a different matallic material from the heat transfer section 20 or by using a thick walled conduit.

FIG. 4 shows the radial distances a and b from the center to section 22' to the outwardly facing locking member 30' and to the inwardly facing locking member 32, respectively. The distances a and b can be the same, or either can be larger. FIG. 4 shows b being larger than a by approximately the thickness of the inwardly facing locking member 32. Preferably, the locking members 30 and 32 are located more than ¼ of the distance from the center section 22 to the tip of the fins 26 and 28, in order to provide sufficient resiliency and clamping force.

Separation of the two heat transfer sections 20 and 20' is a relatively simple matter. Generally, any method that will flex the outwardly facing locking member 30' far enough inward to disengage the inwardly facing locking member 32 will suffice. In particular, FIG. 5 shows a threaded hole 40 in the shorter and relatively more rigid inwardly facing locking member 32, into which a screw 42 fits. A sufficient number of similar threaded holes 40 and screws 42 are provided along the longitudinal direction of the inwardly facing locking member 32. By tightening the screws 42, the tab 31' of the outwardly facing locking member 30' is pushed backwards thereby separating the two heat transfer sections 20 and 20'. The fins may be compressed slightly as an aid to disassembly, the effect being the reduce the friction between the tabs 31 and 33.

FIG. 6 shows an alternative locking unlocking scheme. The resilient locking members 30 and 32 are provided with rectangular shaped grooves 52 and 50. When the fins 26 and 28 are in a compressed state for assembly, the two rectangular sections are coincident and form one large rectangular section or key way into which a rectangular retaining key 54 is inserted. Removal of the external deflecting force will leave the heat transfer sections 20 and 20' locked together tightly around the conduit 36. The natural restoring force of the longer locking member 30 against the shorter locking member 32 will secure the key 54 in a radial direction. In addition, the natural tendency of the fins to move away from each other, and thus to their nonstressed state, will keep the key 54 fixed in place. Separation of the two heat transfer sections 20 and 20' is accomplished by restressing the fins to reduce the force on the key 54, thus allowing its easy removal.

FIG. 3 illustrates an important advantage of the present heat exchanger in which ambient air is permitted to freely circulate immediately around the center sections 22. This is acomplished in part by locating the locking members 30 and 32 a predetermined distance from the center sections 22, thereby permitting air to circulate in the space in between and reducing the amount of ice which accumulates on the heat exchanger and making more efficient the heat transfer to the conduit 36. In addition, heat transfer is added by the increased surface area afforded by the locking members 30 and 32.

What is claimed is:

1. A method for removably attaching heat transfer sleeve sections having a plurality of heat transfer fins to a conduit, comprising the steps of:

locating interlocking means on said heat transfer fins a predetermined distance from the center of said heat transfer sleeves;

elastically deflecting adjacent heat transfer fins of adjacent heat transfer sleeve sections toward one another so that said heat transfer fins are in a flex state when said adjacent interlocking means are engaged, thereby causing said heat transfer sections to compress against the conduit; and detachably joining said adjacent fins so that elastic deformation of said fins is maintained.

2. A heat exchanger for changing the temperature of a cryogenic fluid which is flowing through a conduit, comprising;

a heat transfer element in close contact with said conduit and extending along the longitudinal dimension of said conduit, said element transfering heat to said fluid through said conduit to change the temperature of said fluid, said element comprising:

a center portion in close partial circumferential contact with said conduit;

a plurality of fins extending substantially radially from said center portion; and means on at least one of said fins for joining the said element to an adjacent element around said conduit, said joining means cooperating with the corresponding joining means of said adjacent element to take advantage of the resiliency of said fins, said fins and said joining means providing means for clampaing said center portion against said conduit to maintain said close contact with said conduit as said conduit undergoes thermal contraction due to said cryogenic fluid.

3. An ambient heat exchanger for vaporizing a cryogenic fluid, comprising:

a conduit through which such fluid is passed;

a heat transfer sleeve in close contact with said conduit and extending substantially the entire length of said conduit, said sleeve transfering heat from the ambient air to said fluid through said conduit to vaporize said fluid, said sleeve comprising at least a pair of heat transfer sections removably assembled on said conduit, each said sleeve section comprising;

a central arcuate portion in intimate partial circumferential contact with said conduit;

a plurality of said heat transfer fins extending radially from said central portion; and means on said fins adjacent the other heat transfer section for joining said pair of heat transfer sections, said joining means and the resilience of said fins providing a clamping force for maintaining said central portion in close contact with said conduit as said conduit undergoes thermal contraction due to said cryogenic fluid.

4. The heat exchanger of claim 3 wherein said joining means are located on said fins a predetermined distance from said central portion, the resiliency of said fins providing said clamping force.

5. The heat exchanger of claim 4 wherein said predetermined distance is such that said fins are not plastically deformed when said heat transfer sections are assembled around said conduit.

6. The heat exchanger of claim 4 wherein said joining means are located on said fins more than one quarter of the distance from said central portion to the tip of said fins.

7. The heat exchanger of claim 3 wherein said clamping force is derived from said joining means which joins said pair of heat transfer sections together around said conduit.

8. The heat exchaner of claim 3 wherein said clamping force is provided by spring loading said adjacent heat transfer fins.

9. The heat exchanger of claim 3 wherein said joining means comprises interlocking tabs located on said adjacent fins of said heat transfer sections.

10. The heat exchanger of claim 9 wherein at least one of said tabs is flexible to facilitate assembly and disassembly of said heat transfer sections.

11. The heat exchanger of claim 3 wherein said joining means extend substantially the entire length of said sleeve.

12. The heat exchanger of claim 3 wherein said fins include corrugated surfaces near their tips to increase their surface area to provide more efficient heat transfer.

13. An ambient heat exchanger for vaporizing a cryogenic fluid, comprising:

a conduit through which said fluid is passed;

a heat transfer sleeve in close contact with said conduit and extending along the longitudinal dimension of said conduit, said sleeve transferring heat to said fluid through said conduit to vaporize said fluid, said sleeve comprising at least a pair of heat transfer sections removably assembled on the said conduit, each said heat transfer section comprising;

a central arcuate portion in close thermal and circumferential contact with said conduit over a distance of less than 180°;

a plurality of heat transfer fins extending substantially radially from said central portion, two of said fins being adjacent the other said heat transfer section; and interlocking means on said adjacent heat transfer fins for joining said heat transfer sections securely on said conduit, said interlocking means being positioned on said adjacent fins such that said fins are in a flexed state when said pair of heat transfer sections are assembled on said conduit, the resiliency of said adjacent fins in a circumferential direction providing a clamping force for maintaining said central portion in close thermal contact with said conduit as said conduit contracts due to the cold temperature of said cryogenic fluid.

14. The ambient heat exchanger of claim 13 wherein said interlocking means comprise outwardly and inwardly facing interlocking tabs extending from said adjacent heat transfer fins, said tabs interlocking with complimentary tabs located on said adjacent heat transfer fins on the other heat transfer section.

15. An ambient heat exchanger for vaporizing a cryogenic fluid, comprising:

a conduit through which said fluid is passed;

a heat transfer sleeve in close contact with said conduit and extending along the longitudinal dimension of said conduit, said sleeve transferring heat to said fluid through said conduit to vaporize said fluid, said sleeve comprising at least a pair of heat transfer sections removably assembled on the said conduit, each said heat transfer section comprising:

a central arcuate portion in close thermal and circumferential contact with said conduit over a distance of less that 180°;

a plurality of heat transfer fins extending substantially radially from said central portion, two of said fins being adjacent the other said heat transfer section; and interlocking means on said adjacent heat transfer fins for joining said heat transfer sections securely on said conduit, the resiliency of said adjacent fins in a circumferential direction providing a clamping force for maintaining said central portion in close thermal contact with said conduit as said conduit contracts due to the cold temperature of said cryogenic fluid, said interlocking means comprise outwardly and inwardly facing interlocking tabs extending from said adjacent heat transfer fins, said tabs interlocking with complimentary tabs located on said adjacent heat transfer fins on the other heat transfer section.

* * * * *

UNITED STATES PATENT AND TRADEMARK OFFICE

CERTIFICATE OF CORRECTION

PATENT NO. : 4,487,256

DATED : December 11, 1984

INVENTOR(S) : Lutjens, et al.

It is certified that error appears in the above-identified patent and that said Letters Patent is hereby corrected as shown below:

| | |
|---|---|
| Column 1, Line 50: | "proglems" should be changed to --problems-- |
| Column 6, Line 24: | "simulaneously" should be changed to --simultaneously-- |
| Column 6, Line 66: | "contrasts" should be changed to --contracts-- |

Signed and Sealed this

First Day of September, 1987

*Attest:*

*Attesting Officer*

DONALD J. QUIGG

*Commissioner of Patents and Trademarks*